United States Patent [19]

Lehneis

[11] Patent Number: 4,794,743

[45] Date of Patent: Jan. 3, 1989

[54] CANE SUPPORTING APPARATUS

[76] Inventor: Hans R. Lehneis, 13 Landing Rd., Roslyn, N.Y. 11576

[21] Appl. No.: 119,537

[22] Filed: Nov. 12, 1987

[51] Int. Cl.[4] ..... A42B 7/00

[52] U.S. Cl. ..... 135/65; 135/86; 248/359 E

[58] Field of Search ..... 135/65, 66; 248/155, 248/359.1, 359 E, 359 M

[56] References Cited

U.S. PATENT DOCUMENTS

| | | | |
|---|---|---|---|
| 569,936 | 10/1896 | Potter | 248/359 E |
| 1,329,915 | 2/1903 | McKenzie | 135/65 |
| 3,302,910 | 2/1967 | Williams | 248/359 |
| 3,414,133 | 12/1968 | Guerri | 135/66 |
| 4,258,735 | 3/1981 | Meade | 135/65 |
| 4,299,409 | 11/1981 | Gedicks | 135/66 |

FOREIGN PATENT DOCUMENTS

| | | | |
|---|---|---|---|
| 239433 | 9/1925 | United Kingdom | 248/155 |

*Primary Examiner*—Henry E. Raduazo

*Attorney, Agent, or Firm*—Darby & Darby

[57] ABSTRACT

A cane supporting apparatus is made from a light weight piece of material which has an upright contact surface having a width which is several times the diameter of the cane. Generally perpendicular to the upright contact surface is a generally horizontal contact surface, and both of these surfaces are made to have a high coefficient of friction. In the horizontal contact surface, the apparatus is provided with a through-hole which is dimensioned to receive the cane with a slight amount of resistance. The apparatus may therefore be slipped over the cane with the horizontal contact surface generally perpendicular to the length of the cane. The cane may then be supported against a wall or similar surface by means of the upright contact surface of the apparatus or with respect to a table surface by means of the contact surface of the apparatus. In a preferred embodiment the apparatus also includes a hollow insertion member which is inserted over the end of the cane and includes a high friction lower contacting surface. The insertion member is constructed to be stored in the through hole.

12 Claims, 1 Drawing Sheet

CANE SUPPORTING APPARATUS

FIELD OF THE INVENTION

The present invention relates to an apparatus which aids in supporting a cane, or the like, in an upright position when it is not in use.

BACKGROUND OF THE INVENTION

In one form or another, the cane has been used by man since ancient times as an aid in walking. The patient using the cane has, however, always faced the problem of how to store the cane when it is not used. The most obvious choice of placing the cane upon the floor is usually not a practical one, since the patient is unable to walk without the aid of a cane and picking up the cane from the floor is a task which is even more difficult than walking. Furthermore, if placed on the floor, the cane may not be seen readily and could be tripped over. Laying the cane upon a table or other similar surface is also not an acceptable solution, because the cane takes up a substantial amount of space and the same dangers are present as when the cane is placed upon the floor. Patients have therefore resorted to storing canes in an upright position, either leaning against a wall or a piece of furniture or supported by its handle or crook. However, this is not a stable position for a cane, and the cane typically falls over as people walk on the floor and it must be repositioned repeatedly.

It is therefore an object of the present invention to provide an apparatus which can support a walking cane in a relatively stable upright position and which may readily be carried by the patient, for example, in a pocket, for use whenever the cane is not in use.

It is an object of the present invention to provide such a cane supporting apparatus which is capable of supporting the cane in a variety of different positions, such as in an upright position leaning against the wall or supported by a table surface, or the like.

It is a further object of the present invention to provide a cane supporting apparatus which is reliable and convenient in use, yet relatively inexpensive in construction.

In accordance with the present invention, a cane supporting apparatus is made from a light weight piece of material which has an upright contact surface having a width which is several times the diameter of the cane. Generally perpendicular to the upright contact surface is a generally horizontal contact surface, and both of these surfaces are made to have a high coefficient friction. In the horizontal contact surface, the apparatus is provided with a through-hole which is dimensioned to receive the cane with a slight amount of resistance. The apparatus may therefore be slipped over the cane with the horizontal contact surface generally perpendicular to the length of the cane. The cane may then be supported against a wall or similar surface by means of the upright contact surface of the apparatus or with respect to a table surface by means of the horizontal contact surface of the apparatus.

BRIEF DESCRIPTION OF THE DRAWING

The foregoing brief description, as well as further objects features and advantages of the present invention will be understood more completely from the following detailed description of a presently preferred, but nonetheless illustrative, embodiment of the present invention, with reference being had to the accompanying drawing, in which.

DETAILED DESCRIPTION OF THE PREFERRED EMBODIMENT

Figure 1:
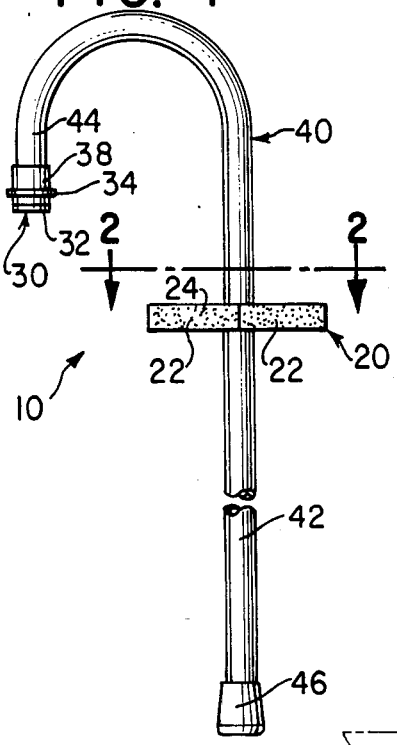
FIG. 1 is an elevational view of a preferred embodiment of a cane supporting apparatus in accordance with the present invention, with the apparatus being shown positioned for use on a cane.
Figure 2:
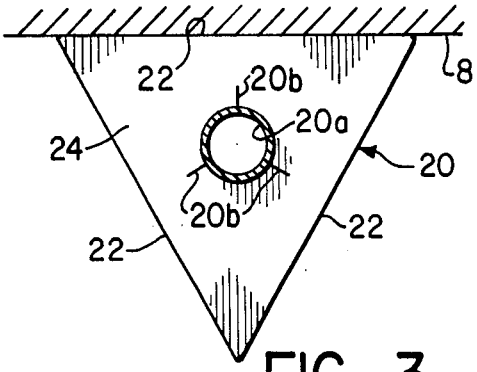
FIG. 2 is a sectional view, on an enlarged scale, taken along line 2—2 in FIG. 1 and looking in the direction of the arrows.

Referring now to the details of the drawing, there is illustrated a cane supporting apparatus 10 embodying objects and features of the present invention. The apparatus 10 broadly comprises a main body member 20 and an insertion member 30, both of which are adapted to be mounted on a conventional cane 40. The main body member includes an aperture **20*a* which is dimensioned to receive the shaft portion or member 42 of cane 40, and insertion member 30 is hollow and has an inside diameter of a sufficient size to permit it to be inserted over the end of the handle or crook portion or member 44 of the cane 40**.

In use, members 20 and 30 of the cane supporting apparatus 10 may be mounted on the cane 40 as illustrated in FIG. 1. The cane may then be supported against a wall 8 or similar upright surface by placing the high friction upright contacting surface 22 of body member 20 against the wall 8. Alternately, the cane may be supported with respect to a table top 9 or similar horizontal surface by adjusting the members 20 and 30 so that a high friction horizontal contacting surface 24 of member 20 and high friction contacting surface 32 of element 30 engage the table top 9 so as to maintain the cane in a stable position. Although preferred for stability, it is not essential that the surfaces 32 and 24 be on opposite sides of the table top 9, since cane 40 will readily be supported on top of the table if apparatus 10 is applied to the cane so that surfaces 32 and 24 contact the same side (the upper surface) of the table top. It is also possible to support the cane by means of main body 20 only, without making use of insertion member 30. This might be done, for example, if the table top 9 were too close to the floor to permit surface 32 to make contact with it. For purposes of stability, it is preferred that, in all instances, the foot of the cane 46 remain in contact with the floor. Similarly, there may be some instances in which a patient may choose to use only insertion member 30.

Figure 3:
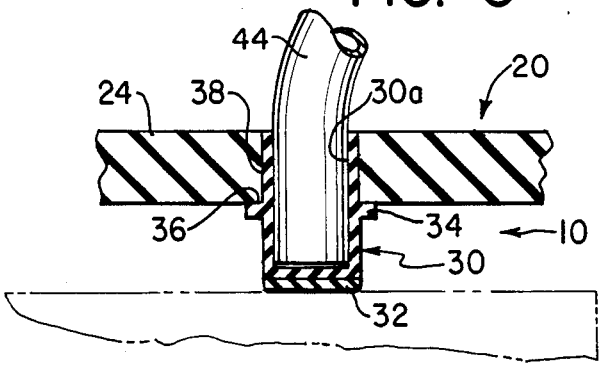
FIG. 3 is a fragmentary sectional view showing the preferred embodiment of the invention in its assembled form as first applied to the handle of the cane.

When the apparatus 10 is not in use, it may be left on the cane as shown in FIG. 1, or the members 20 and 30 may be assembled as shown in FIG. 3 and left on the handle of the cane. Alternately, the members 20 and 30 may be assembled as shown in FIG. 3, and the apparatus 10 may be removed from the cane and carried by the patient, for example, in his pocket.

In the presently preferred embodiment, the body member 20 is cut from a sheet of stiff rubber material approximately half an inch thick. Body member 20 is conveniently cut in the shape of a triangle, to yield three upright contacting surfaces 22. However, it will be appreciated that, in order for apparatus 10 to be effective, it is only essential to provide a single upright contacting surface, and body component 20 may be cut in any shape, including any polygon-shape, which will yield at least one straight contacting surface. The length of contacting surface 22 should be several times the diameter of the cane. For example, for a three-quarter inch diameter cane, each surface 22 is preferably approximately 4 inches long, so that the side 22 is 4 to 5 times the diameter of the cane.

A horizontal high friction contacting surface 24 is provided on body component 20 so as to be generally perpendicular to the contacting surface(s) 22. Since the component 20 is preferably made of rubber, its upper and lower surfaces can both serve as contacting surface 24.

Component 20 has a aperture **20*a* which is dimensioned to receive the shaft member 42 of cane 40. Preferably, aperture 20*a* is somewhat smaller in diameter than shaft member 42, slits 20*b* are provided to impart a degree of resilience to aperture 20*a*. This permits the component 20 to be moved readily along shaft member 42 of the cane, yet sufficient friction is provided to maintain component 20 is a selected position on the cane. If body component 20 exhibits sufficient resilience on its own or a resilient insert is provided in aperture 20*a*, it may not be necessary to include the slits 20*b***.

It will be appreciated that although body member 20 is preferably made of rubber, it could readily be made of any light weight, low cost material. For example, body component 20 could be hollow and could be molded from plastic. The high friction surfaces 22 and 24 could then be provided by coating the appropriate surfaces of body component 20 or bonding a high friction material thereto. Aperture **20*a*** could similarly be provided with a frictional coating and, preferably, a resilient insert, or the like.

Insertion member 30 of apparatus 10 is preferably molded from plastic, although it may also be made of rubber. Member 30 is provided with a cylindrical bore **30*a* of a sufficient diameter to receive the handle member 44 of cane 40 (see e.g. FIG. 3). Handle member 44 should have a slight interference fit within bore 30*a*, so that component 30 will be frictionally retained on handle 44, once it is placed in position. Component 30 includes a lower, high friction contacting surface 32 for the purpose described above. This may be in the form of a coating or a sheet material bonded to the lower surface of component 30. Intermediate its upper and lower ends, component 30 includes a flange or bead member 34, which defines an annular seat 36 for engaging the horizontal surface of component 20 in the vicinity of aperture 20*a*. The member 38 of component 30 above flange 34 is provided with an outside diameter just slightly larger than the handle member 44 of cane 40. Member 38 is therefore conveniently inserted into aperture 30*a* until seat 36 engages member 20**, and it will be retained in this position through friction.

Figure 4:
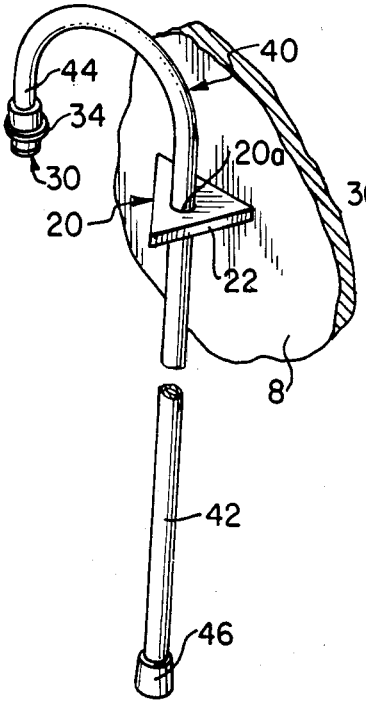
FIG. 4 is a perspective view illustrating how the apparatus of the present invention supports the cane against a wall or other flat surface.
Figure 5:
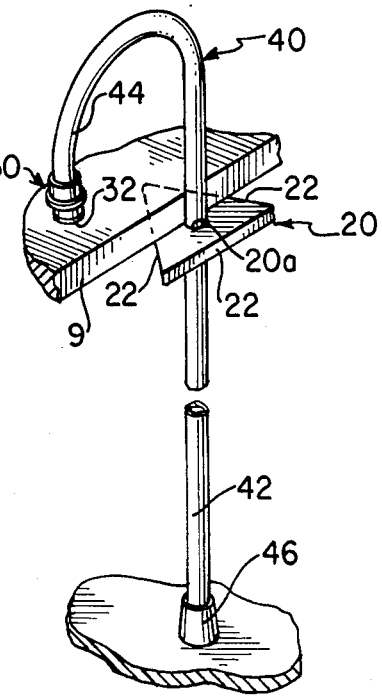
FIG. 5 is a perspective view illustrating how the preferred embodiment may be used to support the cane with respect to a table or similar horizontal surface.

Components 20 and 30 are conveniently carried by the patient in their associated condition. The apparatus 10 is then conveniently applied to the cane by inserting the handle member 44 into aperture **20*a*. Continued upward pressure on component 20 then causes components 20 and 30 to separate, and component 20 may be moved to a desired position along the cane, as appropriate to the conditions under which the cane is to be supported (see e.g. FIGS. 4 and 5**).

Although a preferred embodiment of the invention has been disclosed for illustrative purposes, those skilled in the art will appreciate that many additions, modifications and substitutions are possible, without departing from the scope and spirit of the invention as defined in the accompanying claims.

What is claimed is:

1. An apparatus for supporting in a substantially upright position a cane including a handle portion and a shaft member having a predetermined diameter, said apparatus including a main body member comprising:

a substantially planar, high friction first contacting surface;

means defining a relatively resilient aperture shaped and dimensioned to receive said cane shaft member, said aperture being generally perpendicular to said first contacting surface; and a substantially planar upright contacting surface generally perpendicular to said first contacting surface.

2. An apparatus in accordance with claim 1, wherein said first contacting surface lies on a polygon-shaped surface and said upright contacting surface lies on a plane containing an edge of said polygon.

3. An apparatus in accordance with claim 2, further comprising an additional upright contacting surface lying in a plane including a different edge of said polygon.

4. An apparatus in accordance with claim 1, further comprising an additional upright contacting surface generally perpendicular to said first contacting surface.

5. An apparatus for supporting in a substantially upright position a cane including a handle portion and a shaft member having a predetermined diameter, said apparatus including a main body member comprising:

a substantially planar, high friction first contacting surface;

means defining a relatively resilient aperture shaped and dimensioned to receive said can shaft member, said aperture being generally perpendicular to said first contacting surface; and a substantially planar upright contacting surface generally perpendicular to said first contacting surface; and a hollow insert member dimensioned and shaped to receive the end of the handle member of the cane therein, said insert member having a closed, high friction bottom contacting surface, said insert member having an upper member exteriorly dimensioned and shaped to be received in said main body aperture with a frictional fit.

6. An apparatus in accordance with claim 5, wherein said insert member further comprises a laterally extending flange member intermediate the upper and lower extremes thereof, said flange member defining a seat for limiting the insertion of said upper member into said main body aperture.

7. An apparatus in accordance with claim 6, wherein said first contacting surface lies on a polygon-shaped surface and said upright contacting surface lies on a plane containing an edge of said polygon.

8. An apparatus in accordance with claim 7, further comprising an additional upright contacting surface lying in a plane including a different edge of said polygon.

9. An apparatus in accordance with claim 6, further comprising an additional upright contacting surface generally perpendicular to said first contacting surface.

10. An apparatus in accordance with claim 5, wherein said first contacting surface lies on a polygon-shaped surface and said upright contacting surface lies on a plane containing an edge of said polygon.

11. An apparatus in accordance with claim 10, further comprising an additional upright contacting surface lying in a plane including a different edge of said polygon.

12. An apparatus in accordance with claim 5, further comprising an additional upright contacting surface generally perpendicular to said first contacting surface.

* * * * *